US007528813B2

(12) United States Patent
Nishikubo et al.

(10) Patent No.: US 7,528,813 B2
(45) Date of Patent: May 5, 2009

(54) LIQUID CRYSTAL DISPLAY DEVICE, DRIVING CIRCUIT FOR THE SAME AND DRIVING METHOD FOR THE SAME

(75) Inventors: Keishi Nishikubo, Tokyo (JP); Kozo Takahashi, Tokyo (JP)

(73) Assignee: Sharp Kabushiki Kaisha, Osaka (JP)

( * ) Notice: Subject to any disclaimer, the term of this patent is extended or adjusted under 35 U.S.C. 154(b) by 727 days.

(21) Appl. No.: 11/123,081

(22) Filed: May 6, 2005

(65) Prior Publication Data

US 2006/0007210 A1 Jan. 12, 2006

(30) Foreign Application Priority Data

Jun. 25, 2004 (JP) ..... 2004-187439

(51) Int. Cl.
*G09G 3/36* (2006.01)

(52) U.S. Cl. ..... 345/87; 345/92; 345/94; 345/96; 345/97

(58) Field of Classification Search ..... 345/87, 345/92, 94, 96–97
See application file for complete search history.

(56) References Cited

U.S. PATENT DOCUMENTS 5,398,043 A * 3/1995 Takeda et al. ..... 345/94

FOREIGN PATENT DOCUMENTS

JP 2001-188217 A 7/2001

* cited by examiner

*Primary Examiner*—Richard Hjerpe
*Assistant Examiner*—Leonid Shapiro
(74) *Attorney, Agent, or Firm*—Harness, Dickey & Pierce, P.L.C.

(57) ABSTRACT

An auxiliary capacitance electrode driving circuit outputs an auxiliary capacitance electrode driving signal alternating between high potential and low potential once every horizontal scanning period. A common electrode driving circuit drives a common electrode such that it also alternates between high potential and low potential once every horizontal scanning period. In an auxiliary capacitance potential setting circuit, the anode of a diode is connected to an auxiliary capacitance electrode driving signal line and the cathode of the diode is connected to a ground conductor. A node between the anode of the diode and the auxiliary capacitance electrode driving signal line is connected via a capacitor to the auxiliary capacitance electrode driving circuit. Thus, the auxiliary capacitance potential setting circuit functions as a clamping circuit for setting an upper limit of the potential of the auxiliary capacitance electrode.

9 Claims, 7 Drawing Sheets

LIQUID CRYSTAL DISPLAY DEVICE, DRIVING CIRCUIT FOR THE SAME AND DRIVING METHOD FOR THE SAME

CROSS REFERENCE TO RELATED APPLICATIONS

This application claims priority under 35 U.S.C. § 119(a) upon Japanese Patent Application No. 2004-187439 titled "LIQUID CRYSTAL DISPLAY DEVICE, DRIVING CIRCUIT FOR THE SAME AND DRIVING METHOD FOR THE SAME," filed on Jun. 25, 2004, the entire content of which is hereby incorporated by reference.

BACKGROUND OF THE INVENTION

1. Field of the Invention

The present invention relates to driving circuits and driving methods for liquid crystal display devices, and more specifically, to driving circuits and driving methods for driving auxiliary capacitance electrodes.

2. Description of the Related Art

Active matrix liquid crystal display devices provided with TFTs (thin film transistors) as switching elements have been known for several years. Such liquid crystal display devices are provided with a liquid crystal panel made of two insulating substrates that are arranged opposite one another. On one substrate of the liquid crystal panel, scanning signal lines (gate bus lines) and video signal lines (source bus lines) are arranged in a lattice, and TFTs are arranged near the intersections of the scanning signal lines and the video signal lines. Each of the TFTs is made of a gate electrode branching off from the scanning signal lines, a source electrode branching off from the video signal lines, and a drain electrode. The drain electrodes are connected to pixel electrodes that are arranged in a matrix on the substrate for forming an image. Also, the substrate on the other side of the liquid crystal panel is provided with an electrode (referred to as "common electrode" below) for applying a voltage between the pixel electrodes and the common electrode. Liquid crystal capacitances are formed by the pixel electrodes and the common electrode.

With such a liquid crystal display device, in order to sequentially select each of the scanning signal lines for one horizontal scanning period each, the application of an active scanning signal to each of the scanning signal lines is repeated with a cycle of one vertical scanning period. Therefore, the charges that have accumulated in the liquid crystal capacitances have to be held for about one vertical scanning period. Since the accumulated charges cannot be held with the liquid crystal capacitances alone, auxiliary capacitances are provided in parallel to the liquid crystal capacitances.

FIG. 5 is a circuit diagram showing the vicinity of a TFT 51 of a conventional liquid crystal display device. A gate electrode 57 of the TFT 51 is connected to a scanning signal line GL, its source electrode 58 is connected to a video signal line SL, and its drain electrode 59 is connected to a pixel electrode 52. Also, a liquid crystal capacitance 55 and an auxiliary capacitance 56 are arranged in parallel. The liquid crystal capacitance 55 is formed by the pixel electrode 52 and the common electrode 53, whereas the auxiliary capacitance 56 is formed by the pixel electrode 52 and the auxiliary capacitance electrode 54.

In a liquid crystal display device as described above, the auxiliary capacitance electrode 54 is arranged on the same substrate as the pixel electrode 52, and there is the possibility of a leakage current, caused by manufacturing defects or the like, flowing between the pixel electrode 52 and the auxiliary capacitance electrode 54. The effect that a leakage current flowing between the pixel electrode 52 and the auxiliary capacitance electrode 54 has is explained with reference to FIGS. 5 and 6. In the configuration shown in FIG. 5, if there is a leakage current flowing between the pixel electrode 52 and the auxiliary capacitance electrode 54, then the liquid crystal display device operates as if there is a short-circuit, as shown in FIG. 6, and the potential of the pixel electrode 52 becomes equal to the potential of the auxiliary capacitance electrode 54. As a result, a voltage corresponding to the potential difference between the auxiliary capacitance electrode 54 and the common electrode 53 is applied to the liquid crystal capacitance 55. Conventionally, the liquid crystal display device is driven such that the potential of the auxiliary capacitance electrode 54 (referred to as "auxiliary capacitance electrode potential") is the same as the potential of the common electrode 53 (referred to as "common electrode potential"). Therefore, in a liquid crystal display device operated in normally-white mode, for example, the locations where the above-mentioned leakage currents occur can be perceived as bright dots. These are also known as bright dot defects, and conventionally, measures to let the bright dot defects be displayed in black (blackening) are performed with a laser or the like.

To address this problem, JP 2001-188217A discloses a liquid crystal display device in which the auxiliary capacitance electrode 54 and the common electrode 53 are driven such that there is always a predetermined potential difference between the auxiliary capacitance electrode potential and the common electrode potential. FIG. 7 is a block diagram showing the overall configuration of such a liquid crystal display device. This liquid crystal display device comprises a gate power source 100, a display control circuit 200, a video signal line driving circuit 300, a scanning signal line driving circuit 400, a liquid crystal panel 500, a common electrode driving circuit 600, an auxiliary capacitance electrode driving circuit 700, and an auxiliary capacitance potential setting circuit 800. Inside the liquid crystal panel 500, a plurality of scanning signal lines GL and a plurality of video signal lines SL are arranged in a lattice, and TFTs 51 serving as switching elements are arranged at the intersections between the scanning signal lines GL and the video signal lines SL. The gate electrodes 57 of the TFTs 51 are connected to the scanning signal lines GL, its source electrodes 58 are connected to the video signal lines SL, and its drain electrodes 59 are connected to the pixel electrodes 52. The common electrode 53 is arranged in opposition to the pixel electrodes 52, and liquid crystal capacitances 55 are formed by the pixel electrodes 52 and the common electrode 53. Moreover, auxiliary capacitance electrodes 54 are provided on the substrate on which the pixel electrodes 52 are provided, and auxiliary capacitances 56 are formed by the pixel electrodes 52 and the auxiliary capacitance electrodes 54. The scanning signal lines GL are connected to the scanning signal line driving circuit 400, and the video signal lines SL are connected to the video signal line driving circuit 300. The auxiliary capacitance electrodes 54 are connected to an auxiliary capacitance electrode driving signal line CSL, and the auxiliary capacitance electrode driving signal line CSL is connected to the auxiliary capacitance electrode driving circuit 700. It should be noted that for the sake of convenience only a portion of the internal configuration of the liquid crystal panel 500 is shown.

An auxiliary capacitance electrode driving signal for driving the auxiliary capacitance electrodes 54 is outputted by the auxiliary capacitance electrode driving circuit 700. An upper limit for the auxiliary capacitance electrode potential applied by the auxiliary capacitance electrode driving signal to the auxiliary capacitance electrodes 54 is set by the auxiliary capacitance potential setting circuit 800, as explained below. As shown in FIG. 7, the auxiliary capacitance potential setting circuit 800 includes a diode 81, resistors 83 and 84, and a capacitor 85. The anode of the diode 81 is connected to the auxiliary capacitance electrode driving signal line CSL. On the other hand, the cathode of the diode 81 is connected to a gate-off power source line GOFFL. Also, one terminal of the gate-off power source line GOFFL is connected to a ground conductor 82. The node 89 connecting the anode of the diode 81 and the auxiliary capacitance electrode driving signal line CSL is connected via a capacitor 85 to the auxiliary capacitance electrode driving circuit 700. With this configuration, the auxiliary capacitance potential setting circuit 800 functions as a so-called clamping circuit. Note that the gate-off power source line GOFFL is a power source line for supplying the voltage with the lower potential of the voltages to be supplied from the gate power source 100 to the scanning signal line driving circuit 400. The voltage with the lower potential of the voltages to be supplied from the gate power source 100 to the scanning signal line driving circuit 400 is referred to below as "gate-off voltage". The voltage with the higher potential of the voltages to be supplied from the gate power source 100 to the scanning signal line driving circuit 400 is referred to below as "gate-on voltage".

Next, the driving of the auxiliary capacitance electrodes 54 is described with reference to FIGS. 7, 8 and 9. The node 89 connecting the anode of the diode 81 and the auxiliary capacitance electrode driving signal line CSL is connected to one side of the capacitor 85. FIG. 8 is a waveform diagram showing the change of the potential of the node 90 between the other side of the capacitor 85 and the auxiliary capacitance electrode driving circuit 700. FIG. 9 is a waveform diagram showing the change of the potential at the node 89. In FIG. 8 and FIG. 9, the potential at the node 88 between the cathode of the diode 81 and the gate-off power source line GOFFL is denoted as Va, the potential at the node 89 is denoted as Vb, and the potential at the node 90 is denoted as Vd. Also, the potential difference (Vd−Va) between the potential Vd and the potential Va when the potential Vd at the node 90 is at high potential is denoted as Vc, whereas the potential difference (Va−Vd) between the potential Vd and the potential Va when the potential Vd at the node 90 is at low potential is denoted as Ve. An auxiliary capacitance electrode driving signal in which high potential and low potential alternate every horizontal scanning period (1H) is outputted from the auxiliary capacitance electrode driving circuit 700, and the potential Vd changes as shown in FIG. 8. When the potential Vd is lower than the potential Va, then the potential Vb increases together with an increase in the potential Vd until the potential Vb and the potential Va are the same potential. At this time, the diode 81 is non-conducting. When the potential Vd is further increased, the diode 81 becomes conducting after the potential Vb and the potential Va have become the same potential. The capacitor 85 is charged in accordance with the potential difference between the potential Vd and the potential Va. The potential Vb does not become higher than the potential Va. When the potential Vd falls, also the potential Vb falls accordingly. At this time, the potential Vb becomes lower than the potential Va by a potential difference corresponding to the sum of the potential difference (Va−Vd) between the potential Vd and the potential Va and the potential difference due to the charging of the capacitor 85. As a result, the potential Vb changes as shown in FIG. 9. Here, the node 89 and the auxiliary capacitance electrodes 54 are at the same potential, so that also the auxiliary capacitance electrode potential Vcs changes as shown in FIG. 9. On the other hand, also the common electrode potential Vcom changes such that high potential and low potential alternate every single horizontal scanning period (1H), but its lower limit is substantially equal to the ground potential GND. Thus, the auxiliary capacitance electrode potential Vcs and the common electrode potential Vcom change as shown in FIG. 10. Note that there is a voltage drop when the diode 81 is conducting, but since this voltage drop is sufficiently small, it can be ignored for the purposes of this explanation.

As shown in FIG. 10, there is always a predetermined potential difference between the auxiliary capacitance electrode potential Vcs and the common electrode potential Vcom. When there is a leakage current, then a voltage corresponding to the potential difference between the auxiliary capacitance electrode potential Vcs and the common electrode potential Vcom is applied to the liquid crystal capacitance 55, as described above. Thus, in the case of liquid crystal display devices employing the normally-white mode, if the auxiliary capacitance electrode potential Vcs and the common electrode potential Vcom are at the same potential, then leakage currents become a cause of bright dots, but if a predetermined potential difference is always maintained between the auxiliary capacitance electrode potential Vcs and the common electrode potential Vcom, then it can be ensured that the pixels where leakage currents occur are displayed in black.

Now, with the above-described liquid crystal display device, the upper limit of the auxiliary capacitance electrode potential Vcs is set based on a voltage supplied with a power source line, such as the gate-off power source line GOFFL. Therefore, if the gate-off power source line GOFFL is used in this manner to set the upper limit of the auxiliary capacitance electrode potential Vcs, then the gate power source 100 requires a power source capability that can supply a voltage for setting the upper limit of the auxiliary capacitor electrode voltage Vcs in addition to the gate-on voltage and the gate-off voltage supplied to the scanning signal line driving circuit 400. There are furthermore the costs required for the parts constituting the auxiliary capacitance potential setting circuit 800 shown in FIG. 7.

SUMMARY OF THE INVENTION

It is an object of the present invention to provide a liquid crystal display device as well as a driving circuit and a driving method for the same, with which a reduction in power consumption and cost reductions can be achieved, while preventing bright dot defects caused by leakage currents.

According to one aspect of the present invention, a driving circuit for driving a display portion comprising pixel electrodes disposed in a matrix arrangement so as to display images; a common electrode provided in opposition to the pixel electrodes so that liquid crystal capacitances serving as first predetermined capacitances are formed; auxiliary capacitance electrodes provided on the same substrate as the pixel electrodes so that auxiliary capacitances serving as second predetermined capacitances are formed; and an auxiliary capacitance electrode driving signal line for transmitting an auxiliary capacitance electrode driving signal for driving the auxiliary capacitance electrodes;

comprises an auxiliary capacitance potential setting circuit for setting an upper limit of the potential of the auxiliary capacitance electrode driving signal to ground potential.

With this configuration, the upper limit of the potential of the auxiliary capacitance electrode driving signal applied to the auxiliary capacitance electrodes is set to ground potential. Thus, even when the common electrode is driven as in the prior art, a predetermined potential difference can be maintained between the auxiliary capacitance electrodes and the common electrode. Therefore, the occurrence of bright dot defects can be prevented even when there are leakage currents in the auxiliary capacitances. By contrast, in the prior art the upper limit of the potential of the auxiliary capacitance electrode driving signal applied to the auxiliary capacitance electrodes was set based on the voltage applied by the power source line within the liquid crystal display device. Therefore, in comparison to the prior art, the required power supply capability is reduced, and the power source IC can be made smaller and a reduction in costs can be achieved.

It is preferable that this driving circuit further comprises an auxiliary capacitance electrode driving circuit for outputting the auxiliary capacitance electrode driving signal to the auxiliary capacitance electrode driving signal line, the auxiliary capacitance potential setting circuit comprising:

a capacitive element; and a rectifying element having an anode that is connected directly to the auxiliary capacitance electrode driving signal line and is connected via the capacitive element to the auxiliary capacitance electrode driving circuit, and a cathode connected to a ground conductor.

With this configuration, the auxiliary capacitance potential setting circuit comprises a capacitive element and a rectifying element, and the auxiliary capacitance electrode driving signal line is connected via the rectifying element to the ground conductor. Thus, an auxiliary capacitance potential setting circuit with a simpler configuration than in the prior art can be realized. Therefore, the number of components constituting the auxiliary capacitance potential setting circuit can be reduced, and further miniaturization and cost reductions can be achieved.

According to another aspect of the present invention, a liquid crystal display device comprises:

pixel electrodes disposed in a matrix arrangement so as to display images;

a common electrode provided in opposition to the pixel electrodes so that liquid crystal capacitances serving as first predetermined capacitances are formed;

auxiliary capacitance electrodes provided on the same substrate as the pixel electrodes so that auxiliary capacitances serving as second predetermined capacitances are formed;

an auxiliary capacitance electrode driving signal line for transmitting an auxiliary capacitance electrode driving signal for driving the auxiliary capacitance electrodes; and an auxiliary capacitance potential for setting circuit setting an upper limit of the potential of the auxiliary capacitance electrode driving signal to ground potential.

With this configuration, in a liquid crystal display device bright dot defects caused by leakage currents in the auxiliary capacitances can be prevented with an auxiliary capacitance potential setting circuit having a simpler circuit configuration than in the prior art. Thus, a liquid crystal display device can be provided with which the power consumption can be reduced, and that can be made more compact and inexpensive than in the prior art.

Yet another aspect of the present invention relates to a method for driving a display portion comprising pixel electrodes disposed in a matrix arrangement so as to display images; a common electrode provided in opposition to the pixel electrodes so that liquid crystal capacitances serving as first predetermined capacitances are formed; auxiliary capacitance electrodes provided on the same substrate as the pixel electrodes so that auxiliary capacitances serving as second predetermined capacitances are formed; and an auxiliary capacitance electrode driving signal line for transmitting an auxiliary capacitance electrode driving signal for driving the auxiliary capacitance electrodes;

wherein an upper limit of the potential of the auxiliary capacitance electrode driving signal is set to ground potential.

These and other objects, features, aspects and advantages of the present invention will become more apparent from the following detailed description of the present invention when taken in conjunction with the accompanying drawings.

DESCRIPTION OF THE PREFERRED EMBODIMENTS

The following is a description of embodiments of the present invention, with reference to the accompanying drawings.

1. Overall Configuration and Operation

Figure 1:
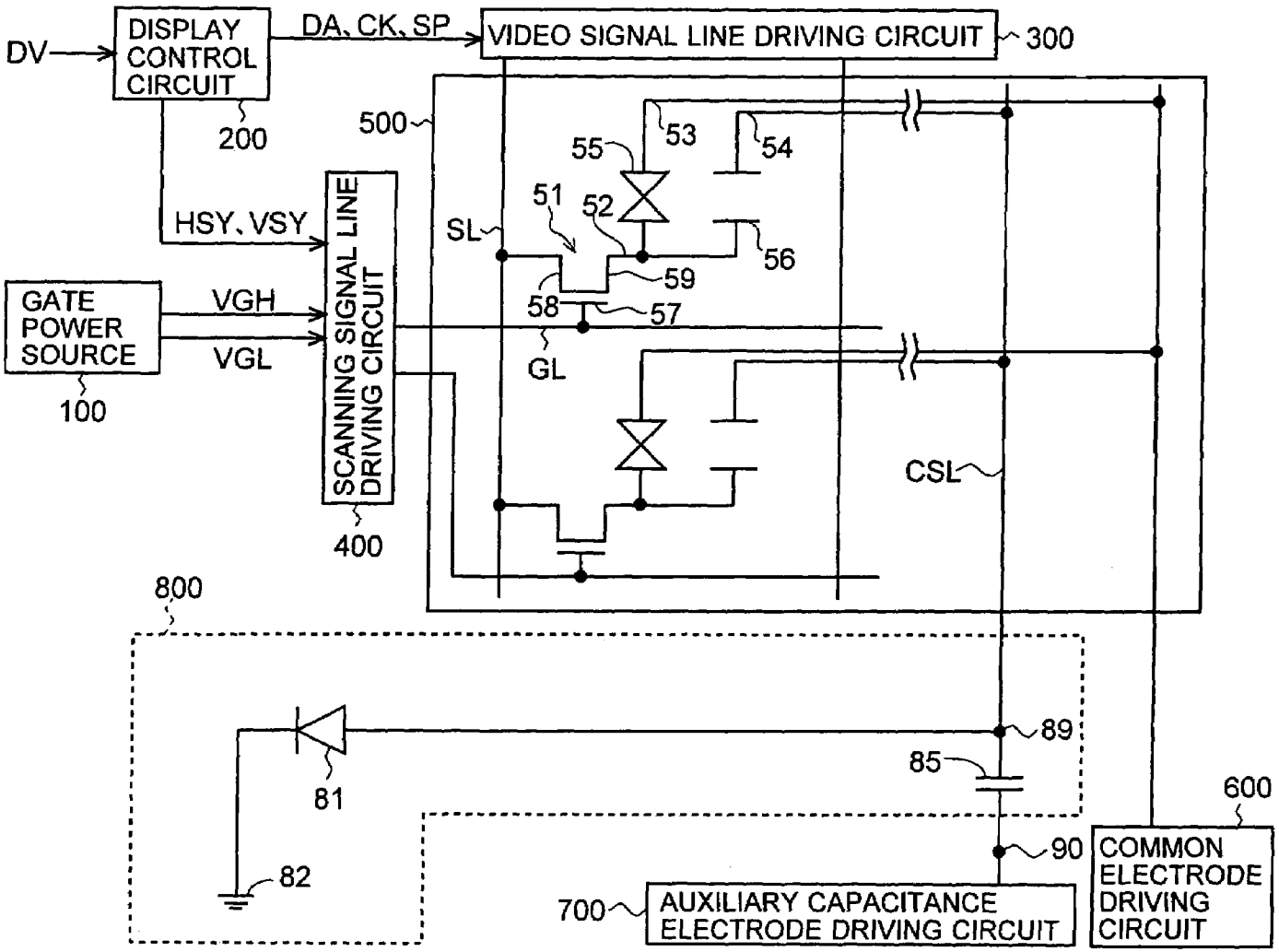
FIG. 1 is a block diagram showing the overall configuration of a liquid crystal display device according to an embodiment of the present invention.

FIG. 1 is a block diagram showing the overall configuration of a liquid crystal display device according to an embodiment of the present invention. This liquid crystal display device comprises a gate power source 100, a display control circuit 200, a video signal line driving circuit 300, a scanning signal line driving circuit 400, a liquid crystal panel 500, a common electrode driving circuit 600, an auxiliary capacitance electrode driving circuit 700, and an auxiliary capacitance potential setting circuit 800. Inside the liquid crystal panel 500, a plurality of scanning signal lines GL and a plurality of video signal lines SL are arranged in a lattice, and TFTs 51 serving as switching elements are arranged at the intersections between the scanning signal lines GL and the video signal lines SL. The gate electrodes 57 of the TFTs 51 are connected to the scanning signal lines GL, its source electrodes 58 are connected to the video signal lines SL, and its drain electrodes 59 are connected to the pixel electrodes 52. A common electrode 53 is arranged in opposition to the pixel electrodes 52, and liquid crystal capacitances 55 are formed by the pixel electrodes 52 and the common electrode 53. Also, auxiliary capacitance electrodes 54 are provided on the substrate on which the pixel electrodes 52 are provided, and auxiliary capacitances 56 are formed by the pixel electrodes 52 and the auxiliary capacitance electrodes 54. The scanning signal lines GL are connected to the scanning signal line driving circuit 400, and the video signal lines SL are connected to the video signal line driving circuit 300. The auxiliary capacitance electrodes 54 are connected to an auxiliary capacitance electrode driving signal line CSL, and the auxiliary capacitance electrode driving signal line CSL is connected to the auxiliary capacitance electrode driving circuit 700. It should be noted that for the sake of convenience only a portion of the internal configuration of the liquid crystal panel 500 is shown.

The gate power source 100 outputs a gate-on voltage VGH and a gate-off voltage VGL. The display control circuit 200 receives image data DV from outside, and outputs image data DA to be displayed, as well as a horizontal synchronization signal HSY, a vertical synchronization signal VSY, a clock signal CK and a start pulse signal SP for controlling the timing with which images are displayed on the liquid crystal panel 500. Based on the image data DA, the clock signal CK and the start pulse signal SP outputted from the display control circuit 200, the video signal line driving circuit 300 generates a video signal for driving the liquid crystal panel 500, and applies this video signal to the video signal lines SL of the liquid crystal panel 500. In order to sequentially select the scanning signal lines GL for one horizontal scanning period each, the scanning signal line driving circuit 400 applies an active scanning signal one by one to each of the scanning signal lines GL and repeats this active scanning signal application with a cycle of one vertical scanning period, based on the horizontal synchronization signal HSY and the vertical synchronization signal VSY outputted from the display control circuit 200.

The common electrode driving circuit 600 drives the common electrode 53. The auxiliary capacitance electrode driving circuit 700 outputs an auxiliary capacitance electrode driving signal for driving the auxiliary capacitance electrodes 54. As explained further below, the auxiliary capacitance potential setting circuit 800 sets an upper limit of the auxiliary capacitance electrode potential Vcs applied to the auxiliary capacitance electrodes 54.

The auxiliary capacitance potential setting circuit 800 comprises a diode (rectifying element) 81 and a capacitor (capacitive element) 85. The anode of the diode 81 is connected to an auxiliary capacitance electrode driving signal line CSL. On the other side, the cathode of the diode 81 is connected to a ground conductor 82. The node 89 between the anode of the diode 81 and the auxiliary capacitance electrode driving signal line CSL is connected via the capacitor 85 to the auxiliary capacitance electrode driving circuit 700. With this configuration, the auxiliary capacitance potential setting circuit 800 functions as a so-called clamping circuit.

2. Driving Method

Figure 2:
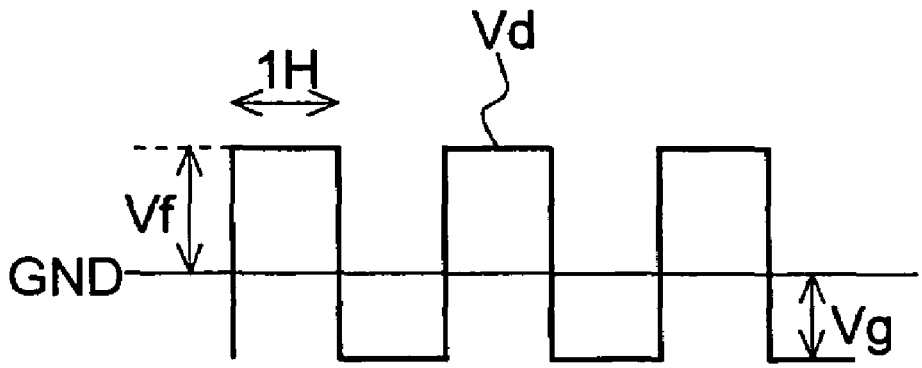
FIG. 2 is a signal waveform diagram of the auxiliary capacitance electrode driving signal outputted from the auxiliary capacitance electrode driving circuit in this embodiment.
Figure 3:
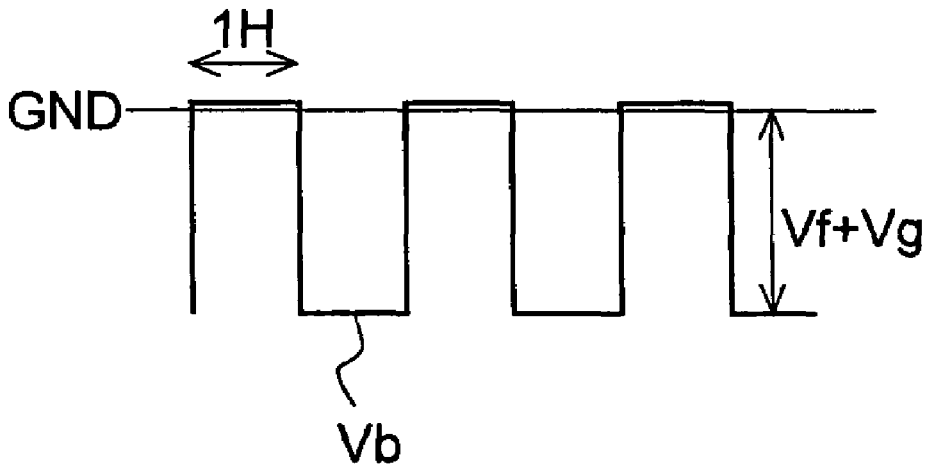
FIG. 3 is a waveform diagram showing the change of the potential at the node connecting the anode of the diode in the auxiliary capacitance potential setting circuit and the auxiliary capacitance electrode driving signal line in this embodiment.

Referring to FIGS. 1, 2 and 3, the following is a description of a method for driving the auxiliary capacitance electrodes 54 and the common electrode 53 in accordance with the present embodiment. The node 89 between the anode of the diode 81 and the auxiliary capacitance electrode driving signal line CSL is connected to one side of the capacitor 85. FIG. 2 is a waveform diagram showing the change of the potential Vd at the node 90 between the other side of the capacitor 85 and the auxiliary capacitance electrode driving circuit 700. FIG. 3 is a waveform diagram showing the change of the potential Vb at the node 89. In FIG. 2 and FIG. 3, the ground potential is denoted as GND. Also, the potential difference (Vd−GND) between the potential Vd and ground potential GND when the potential Vd at the node 90 is at high potential is denoted as Vf, whereas the potential difference (GND−Vd) between the potential Vd and ground potential GND when the potential Vd at the node 90 is at low potential is denoted as Vg. An auxiliary capacitance electrode driving signal in which high potential and low potential alternate every horizontal scanning period (1H) is outputted from the auxiliary capacitance electrode driving circuit 700, and the potential Vd changes as shown in FIG. 2. When the potential Vd is lower than ground potential GND, then the potential Vb increases together with an increase in the potential Vd until the potential Vb is at ground potential GND. At this time, the diode 81 is non-conducting. When the potential Vd is further increased, the diode 81 becomes conducting after the potential Vb has become the ground potential GND. The capacitor 85 is charged in accordance with the potential difference between the potential Vd and ground potential GND. The potential Vb does not become higher than the ground potential GND. When the potential Vd falls, also the potential Vb falls accordingly. At this time, the potential Vb becomes lower than the ground potential GND by a potential difference corresponding to the sum of the potential difference (GND−Vd) between the potential Vd and the ground potential GND and the potential difference due to the charging of the capacitor 85. As a result, the potential Vb changes as shown in FIG. 3. The node 89 and the auxiliary capacitance electrode 54 are at the same potential, so that also the auxiliary capacitance electrode potential Vcs changes as shown in FIG. 3. Also the common electrode potential Vcom changes such that high potential and low potential alternate every single horizontal scanning period (1H), but the lower limit of the common electrode potential is substantially equal to the ground potential. Thus, the auxiliary capacitance electrode potential Vcs and the common electrode potential Vcom change as shown in FIG. 4.

3. Operation

Figure 4:
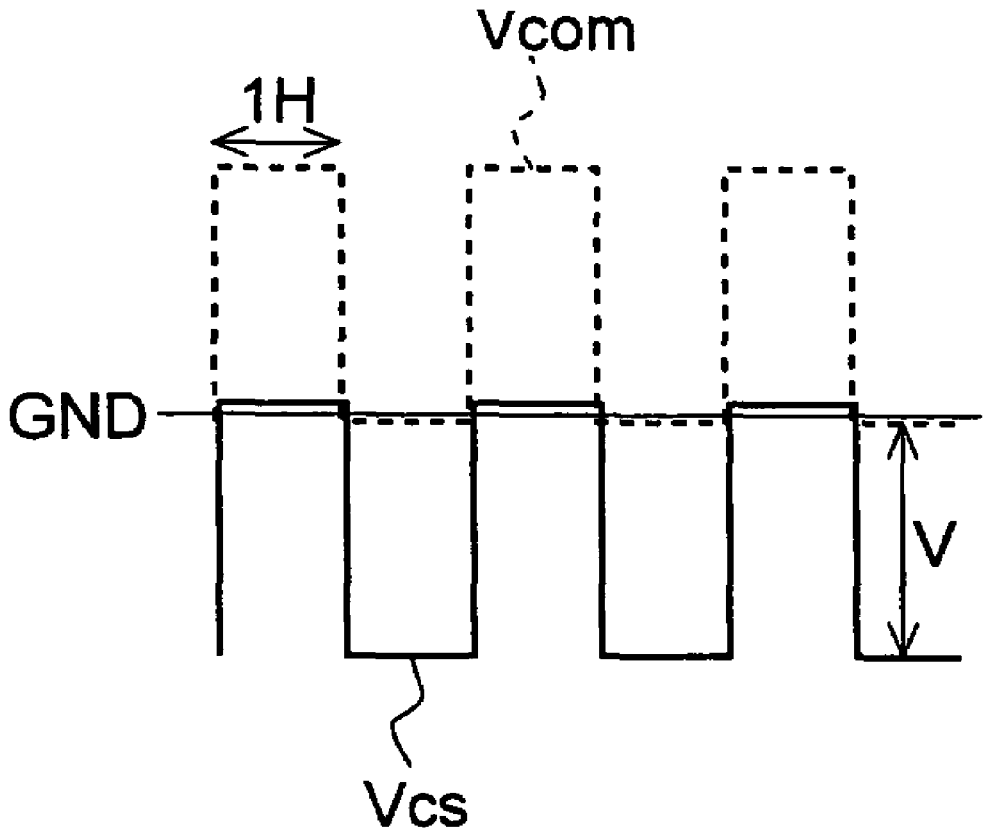
FIG. 4 is a waveform diagram showing the change of the potentials of the auxiliary capacitor electrodes and the common electrode in this embodiment.
Figure 5:
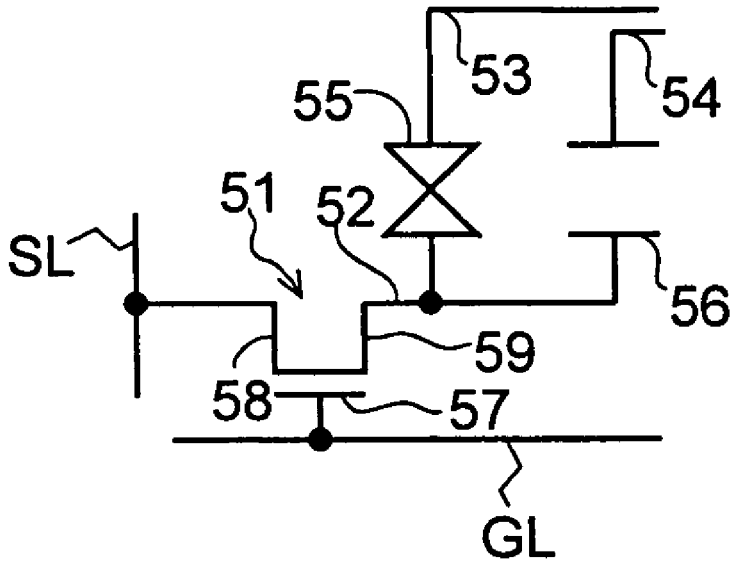
FIG. 5 is a diagram illustrating the effect of leakage currents between the pixel electrodes and the auxiliary capacitor electrodes.
Figure 6:
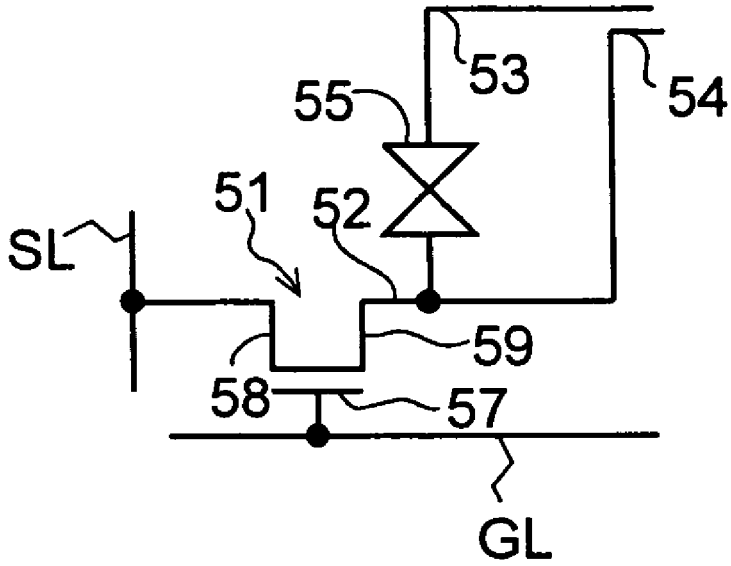
FIG. 6 is a diagram illustrating the effect of leakage currents between the pixel electrodes and the auxiliary capacitor electrodes.
Figure 7:
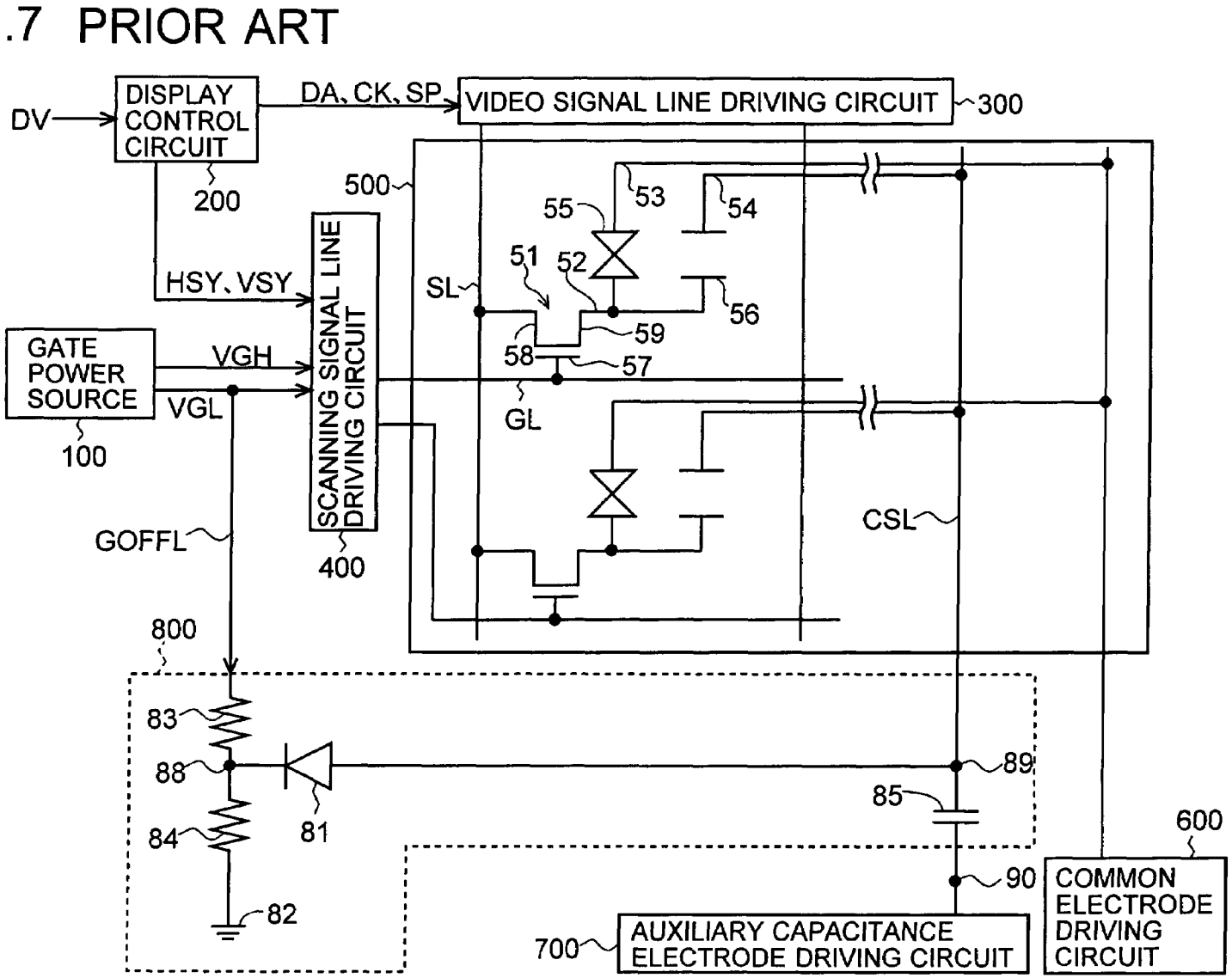
Fig.7 PRIOR ART
FIG. 7 is a block diagram showing the overall configuration of a liquid crystal display device according to an embodiment of the present invention.
Figure 8:
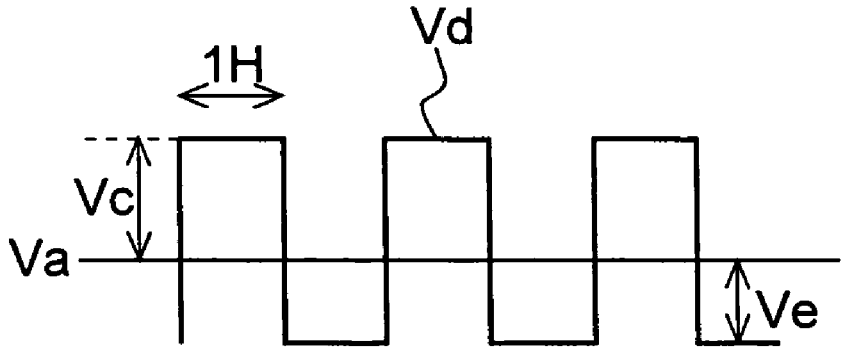
Fig.8 PRIOR ART
FIG. 8 is a signal waveform diagram of the auxiliary capacitance electrode driving signal outputted from the auxiliary capacitance electrode driving circuit in a conventional example.
Figure 9:
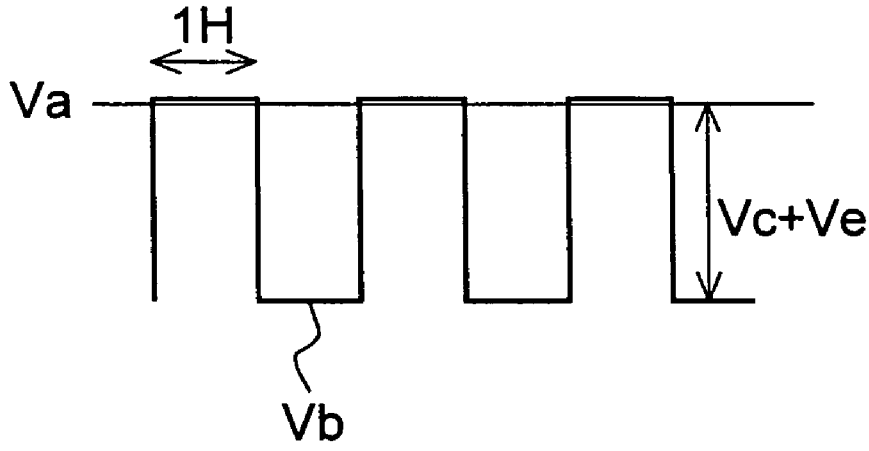
Fig.9 PRIOR ART
FIG. 9 is a waveform diagram showing the change of the potential at the node connecting the anode of the diode in the auxiliary capacitance potential setting circuit and the auxiliary capacitance electrode driving signal line in the conventional example.
Figure 10:
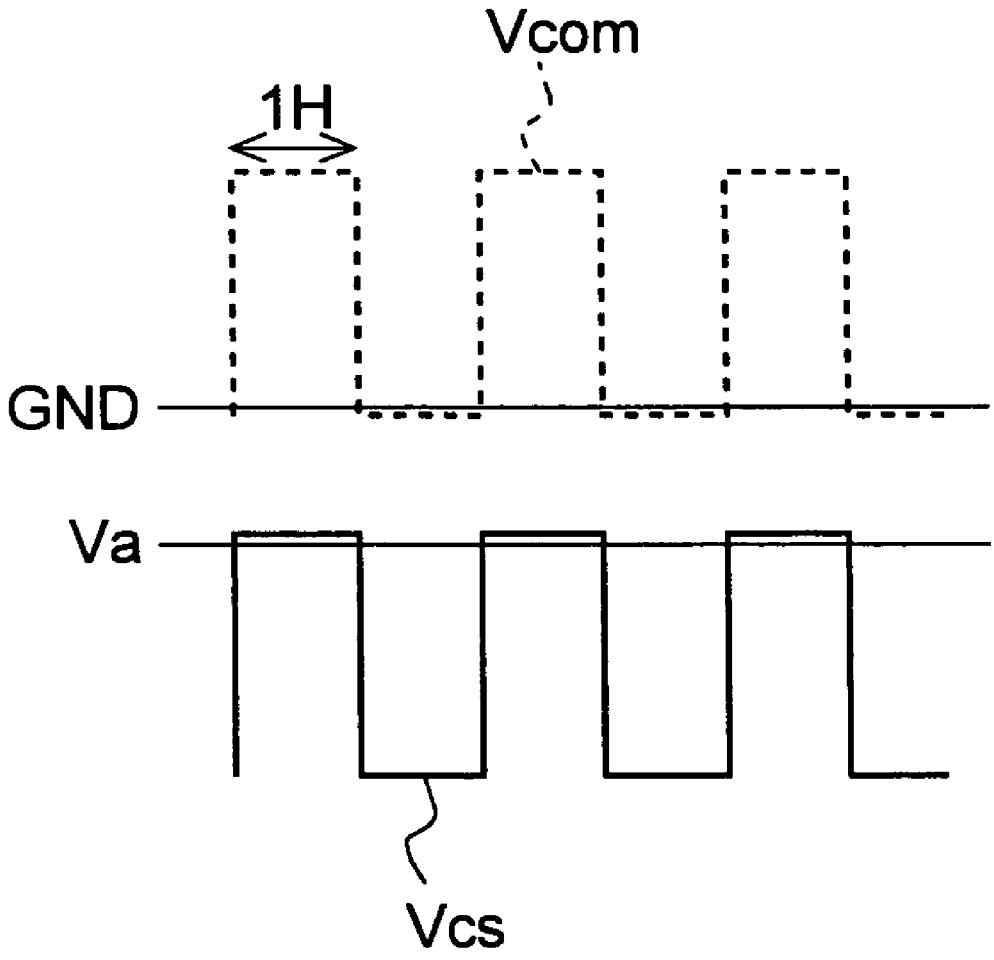
Fig.10 PRIOR ART
FIG. 10 is a waveform showing the change of the potentials of the auxiliary capacitor electrodes and the common electrode in the conventional example.

As shown in FIG. 4, the auxiliary capacitance electrode potential Vcs and the common electrode potential Vcom are repeatedly set to high potential and to low potential at the same timing. The upper limit of the auxiliary capacitance electrode potential Vcs is set to approximately the ground potential GND. On the other hand, the lower limit of the common electrode potential Vcom is set to approximately the ground potential GND as well. Thus, there is always a predetermined potential difference between the auxiliary capacitance electrode potential Vcs and the common electrode potential Vcom.

When there is a leakage current between the pixel electrodes 52 and the auxiliary capacitance electrodes 54, then a voltage corresponding to the potential difference between the auxiliary capacitance electrode potential Vcs and the common electrode potential Vcom is applied to the liquid crystal capacitance 55. In the present embodiment, the voltage represented by the symbol V in FIG. 4 is applied. Thus, the occurrence of bright dot defects due to leakage currents can be prevented in the case of liquid crystal display devices employing the normally-white mode, because a predetermined potential difference is always maintained between the auxiliary capacitance electrode potential Vcs and the common electrode potential Vcom.

4. Advantageous Effect

As explained above, in the present embodiment, in the auxiliary capacitance potential setting circuit 800 the anode of the diode 81 is connected to the auxiliary capacitance electrode driving signal line CSL and the cathode of the diode 81 is connected to the ground conductor 82. Moreover, the node 89 between the anode of the diode 81 and the auxiliary capacitance electrode driving signal line CSL is connected via the capacitor 85 to the auxiliary capacitance electrode driving circuit 700. Thus, the auxiliary capacitance potential setting circuit 800 functions as a clamping circuit, and the upper limit of the auxiliary capacitance electrode potential Vcs is set to ground potential. Since the lower limit of the common electrode potential Vcom is set to ground potential, it is possible to maintain a predetermined potential difference between the auxiliary capacitance electrode potential Vcs and the common electrode potential Vcom.

By contrast, in the prior art, in order to maintain a predetermined potential difference between the auxiliary capacitance electrode potential Vcs and the common electrode potential Vcom, the upper limit of the auxiliary capacitance electrode potential Vcs was set with a voltage supplied by a power source line within the device, such as the gate-off power source line for example. Comparing the present embodiment and the conventional example, there is no need in the present embodiment to provide a power source line within the device in order to maintain a predetermined potential difference between the auxiliary capacitance electrode potential Vcs and the common electrode potential Vcom, so that the power consumption of the present embodiment can be reduced. Thus, the power supply capability that is needed by the gate power source, for example, is lower than in the prior art, so that a miniaturization of the power source IC and a reduction in costs can be achieved. Furthermore, with the present embodiment, the number of parts needed for the auxiliary capacitance potential setting circuit 800 can be reduced in comparison with the conventional example. This allows a further miniaturization and cost reduction of the liquid crystal display device. As described above, a liquid crystal display device can be provided with which it is not only possible to prevent bright dot defects when there are leakage currents, but also to achieve a reduction in power consumption, miniaturization and reduction in costs compared to the prior art.

While the invention has been described in detail, the foregoing description is in all aspects illustrative and not restrictive. It is understood that numerous other modifications and variations can be devised without departing from the scope of the invention.

What is claimed is:

1. A driving circuit for driving a display portion comprising:

pixel electrodes disposed in a matrix arrangement so as to display images;

a common electrode provided in opposition to the pixel electrodes so that liquid crystal capacitances serving as first predetermined capacitances are formed;

auxiliary capacitance electrodes provided on the same substrate as the pixel electrodes so that auxiliary capacitances serving as second predetermined capacitances are formed;

an auxiliary capacitance electrode driving signal line for transmitting an auxiliary capacitance electrode driving signal for driving the auxiliary capacitance electrodes; and the driving circuit comprising an auxiliary capacitance potential setting circuit for setting an upper limit of the potential of the auxiliary capacitance electrode driving signal to ground potential;

wherein the common electrode is set alternately to one of high potential and low potential at every predetermined period;

wherein the auxiliary capacitance electrode is set alternately to one of high potential and low potential at the same timing when the common electrode is set alternately to the high potential and the low potential.

2. The driving circuit according to claim 1, further comprising:

an auxiliary capacitance electrode driving circuit for outputting the auxiliary capacitance electrode driving signal to the auxiliary capacitance electrode driving signal line, the auxiliary capacitance potential setting circuit comprising:

a capacitive element; and a rectifying element having an anode that is connected directly to the auxiliary capacitance electrode driving signal line and is connected via the capacitive element to the auxiliary capacitance electrode driving circuit, and a cathode connected to a ground conductor.

3. The driving circuit according to claim 2, further comprising:

a common electrode driving circuit for driving the common electrode such that a lower limit of the potential of the common electrode is set to ground potential, and the potential of the common electrode is alternated with a predetermined period between high potential and low potential;

wherein the auxiliary capacitance electrode driving circuit lets the potential of the auxiliary capacitance electrode driving signal alternate between high potential and low potential, in synchronization with the alternation of the potential of the common electrode between high potential and low potential.

4. A liquid crystal display device comprising:

pixel electrodes disposed in a matrix arrangement so as to display images;

a common electrode provided in opposition to the pixel electrodes so that liquid crystal capacitances serving as first predetermined capacitances are formed;

auxiliary capacitance electrodes provided on the same substrate as the pixel electrodes so that auxiliary capacitances serving as second predetermined capacitances are formed;

an auxiliary capacitance electrode driving signal line for transmitting an auxiliary capacitance electrode driving signal for driving the auxiliary capacitance electrodes; and an auxiliary capacitance potential setting circuit for setting an upper limit of the potential of the auxiliary capacitance electrode driving signal to ground potential;

wherein the common electrode is set alternately to one of high potential and low potential at every predetermined period;

wherein the auxiliary capacitance electrode is set alternately to one of high potential and low potential at the same timing when the common electrode is set alternately to the high potential and the low potential.

5. The liquid crystal display device according to claim 4, further comprising:

an auxiliary capacitance electrode driving circuit for outputting the auxiliary capacitance electrode driving signal to the auxiliary capacitance electrode driving signal line, the auxiliary capacitance potential setting circuit comprising:

a capacitive element; and a rectifying element having an anode that is connected directly to the auxiliary capacitance electrode driving signal line and is connected via the capacitive element to the auxiliary capacitance electrode driving circuit, and a cathode connected to a ground conductor.

6. The liquid crystal display device according to claim 5, further comprising:

a common electrode driving circuit for driving the common electrode such that a lower limit of the potential of the common electrode is set to ground potential, and the potential of the common electrode is alternated with a predetermined period between high potential and low potential;

wherein the auxiliary capacitance electrode driving circuit lets the potential of the auxiliary capacitance electrode driving signal alternate between high potential and low potential, in synchronization with the alternation of the potential of the common electrode between high potential and low potential.

7. A method for driving a display portion comprising pixel electrodes disposed in a matrix arrangement so as to display images, a common electrode provided in opposition to the pixel electrodes so that liquid crystal capacitances serving as first predetermined capacitances are formed, auxiliary capacitance electrodes provided on the same substrate as the pixel electrodes so that auxiliary capacitances serving as second predetermined capacitances are formed and an auxiliary capacitance electrode driving signal line for transmitting an auxiliary capacitance electrode driving signal for driving the auxiliary capacitance electrodes, the method comprising:

setting an upper limit of the potential of the auxiliary capacitance electrode driving signal to ground potential;

wherein the common electrode is set alternately to one of high potential and low potential at every predetermined period;

wherein the auxiliary capacitance electrode is set alternately to one of high potential and low potential at the same timing when the common electrode is set alternately to the high potential and the low potential.

8. The method of claim 7, wherein the setting step is performed by an auxiliary capacitance potential setting circuit, the auxiliary capacitance potential setting circuit comprising:

a capacitive element; and a rectifying element having an anode that is connected directly to the auxiliary capacitance electrode driving signal line and is connected via the capacitive element to the auxiliary capacitance electrode driving circuit, and a cathode connected to a ground conductor.

9. The method of claim 8, further comprising:

setting a lower limit of the potential of the common electrode to ground potential.

* * * * *